US008806811B1

(12) United States Patent
Tadros et al.

(10) Patent No.: US 8,806,811 B1
(45) Date of Patent: Aug. 19, 2014

(54) THERMALLY NON-CONDUCTIVE LIFTING INSERT FOR INSULATED CONCRETE SANDWICH PANELS

(71) Applicants: Maher K. Tadros, Omaha, NE (US); Mark D. Lafferty, Lincoln, NE (US); Doug Gremel, Seward, NE (US)

(72) Inventors: Maher K. Tadros, Omaha, NE (US); Mark D. Lafferty, Lincoln, NE (US); Doug Gremel, Seward, NE (US)

( * ) Notice: Subject to any disclaimer, the term of this patent is extended or adjusted under 35 U.S.C. 154(b) by 0 days.

(21) Appl. No.: 14/012,575

(22) Filed: Aug. 28, 2013

(51) Int. Cl.
*E04G 21/14* (2006.01)
*E04B 1/38* (2006.01)
*E04G 21/18* (2006.01)

(52) U.S. Cl.
CPC ..... *E04G 21/185* (2013.01)
USPC ..... 52/125.4

(58) Field of Classification Search
CPC ..... E04B 2/30; E04C 5/16; E04C 5/168; E04C 2002/047; E04C 2002/048; E04G 15/04; E04G 17/06; E04G 21/142; B28B 23/005
USPC ..... 52/125.1, 125.4, 125.5, 125.2, 285.1, 52/309.11, 707, 712, 713
See application file for complete search history.

(56) References Cited

U.S. PATENT DOCUMENTS 2,261,602 A * 11/1941 Yeoman ..... 404/57
3,343,227 A * 9/1967 Brown ..... 52/408
3,683,578 A * 8/1972 Zimmerman ..... 52/274
3,722,160 A * 3/1973 Bentley ..... 52/278
3,724,157 A * 4/1973 Miram ..... 52/745.03
3,993,341 A * 11/1976 Bentley ..... 294/89
3,996,713 A * 12/1976 Haeussler ..... 52/309.12
4,182,092 A * 1/1980 Weaver ..... 52/584.1
4,393,635 A * 7/1983 Long ..... 52/309.11
4,805,366 A * 2/1989 Long ..... 52/309.11
5,119,606 A * 6/1992 Graham ..... 52/125.4
6,230,447 B1 * 5/2001 Pribyl et al. ..... 52/125.2
7,032,354 B2 * 4/2006 Hansort ..... 52/125.3
7,124,547 B2 * 10/2006 Bravinski ..... 52/426
7,905,063 B2 * 3/2011 Kelly ..... 52/125.5
8,555,583 B2 * 10/2013 Ciuperca ..... 52/309.12
2013/0139451 A1 * 6/2013 Sladojevic ..... 52/125.4

FOREIGN PATENT DOCUMENTS

FR 2531739 A1 * 2/1984 ..... E04G 17/04
GB 2183687 A * 6/1987 ..... E04B 2/30
JP 10280426 A * 10/1998 ..... E02D 27/00

* cited by examiner

*Primary Examiner* — Christine T Cajilig
(74) *Attorney, Agent, or Firm* — Suiter Swantz pc llo

(57) ABSTRACT

A lifting insert for a concrete sandwich panel is disclosed. The lifting insert includes a fiberglass rod and two end sleeves secured to two opposite ends of the fiberglass rod. The two end sleeves create confinement of fibers of the fiberglass rod to improve stress resistance of the fiberglass rod. The two end sleeves are also separated by a predetermined distance apart from each other to prevent/reduce thermal bridging. The lifting insert further includes two anchoring members secured to the two end sleeves for anchoring the fiberglass rod within the concrete sandwich panel.

7 Claims, 10 Drawing Sheets

THERMALLY NON-CONDUCTIVE LIFTING INSERT FOR INSULATED CONCRETE SANDWICH PANELS

TECHNICAL FIELD

The disclosure generally relates to the field of sandwich panels, particularly to a thermally non-conductive lifting insert for insulated concrete sandwich panels.

BACKGROUND

Precast concrete is a form of construction, where concrete is cast in a reusable mould or form which is then cured in a controlled environment. A precast sandwich panel (may also be referred to as double wall precast) may include two wythes (panels or layers) of concrete sandwiched around an insulating layer having a high R-value (a measure of thermal resistance).

SUMMARY

The present disclosure is directed to a lifting insert for a concrete sandwich panel. The lifting insert includes a fiberglass rod and two end sleeves secured to two opposite ends of the fiberglass rod. The two end sleeves create confinement of fibers of the fiberglass rod to improve stress resistance of the fiberglass rod. The two end sleeves are also separated by a predetermined distance apart from each other to prevent/reduce thermal bridging. The lifting insert further includes two anchoring members secured to the two end sleeves for anchoring the fiberglass rod within the concrete sandwich panel.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Figure 1:
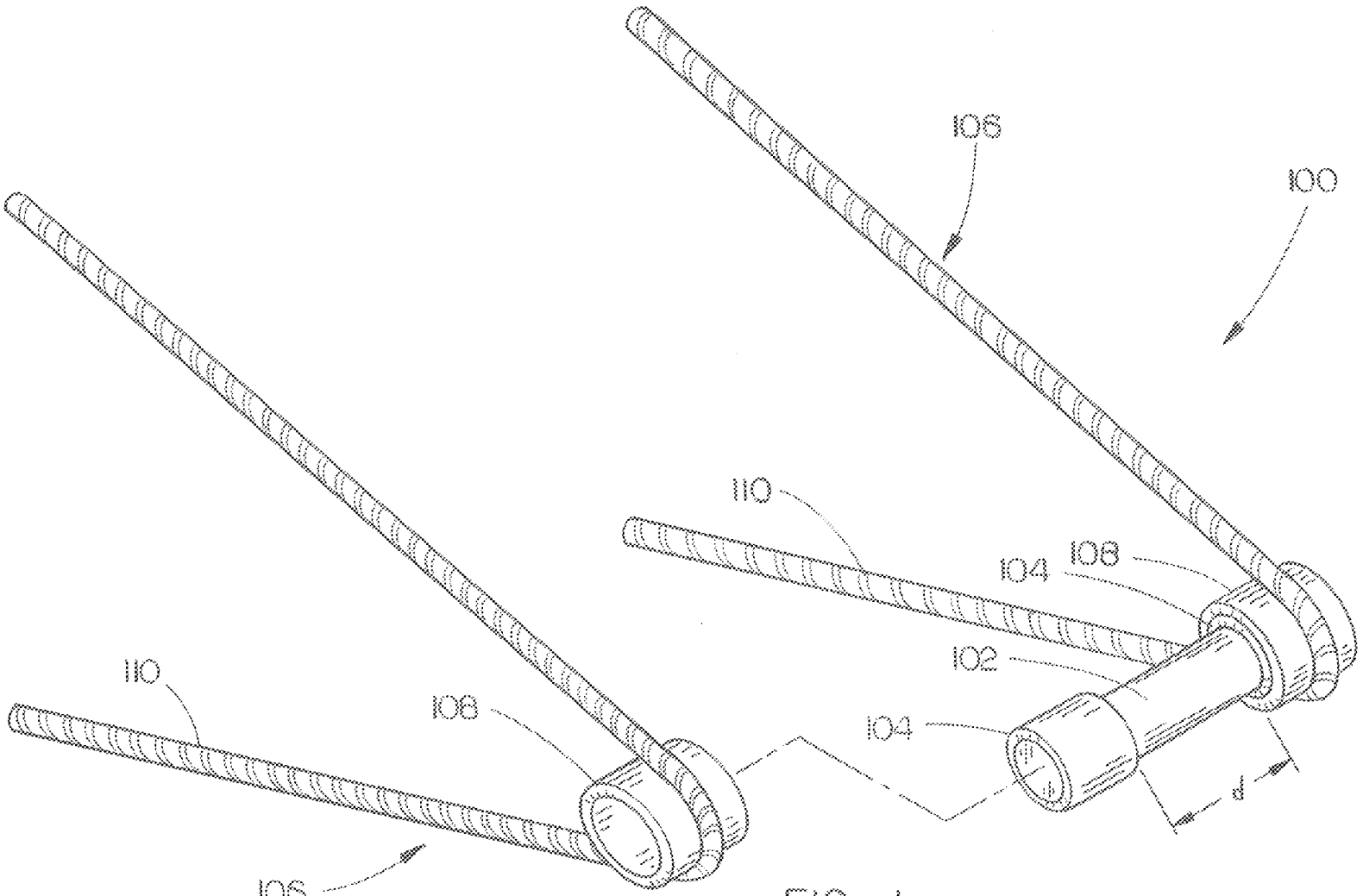
FIG. 1 is a partial exploded isometric view of a lifting insert for a concrete sandwich panel.
Figure 2:
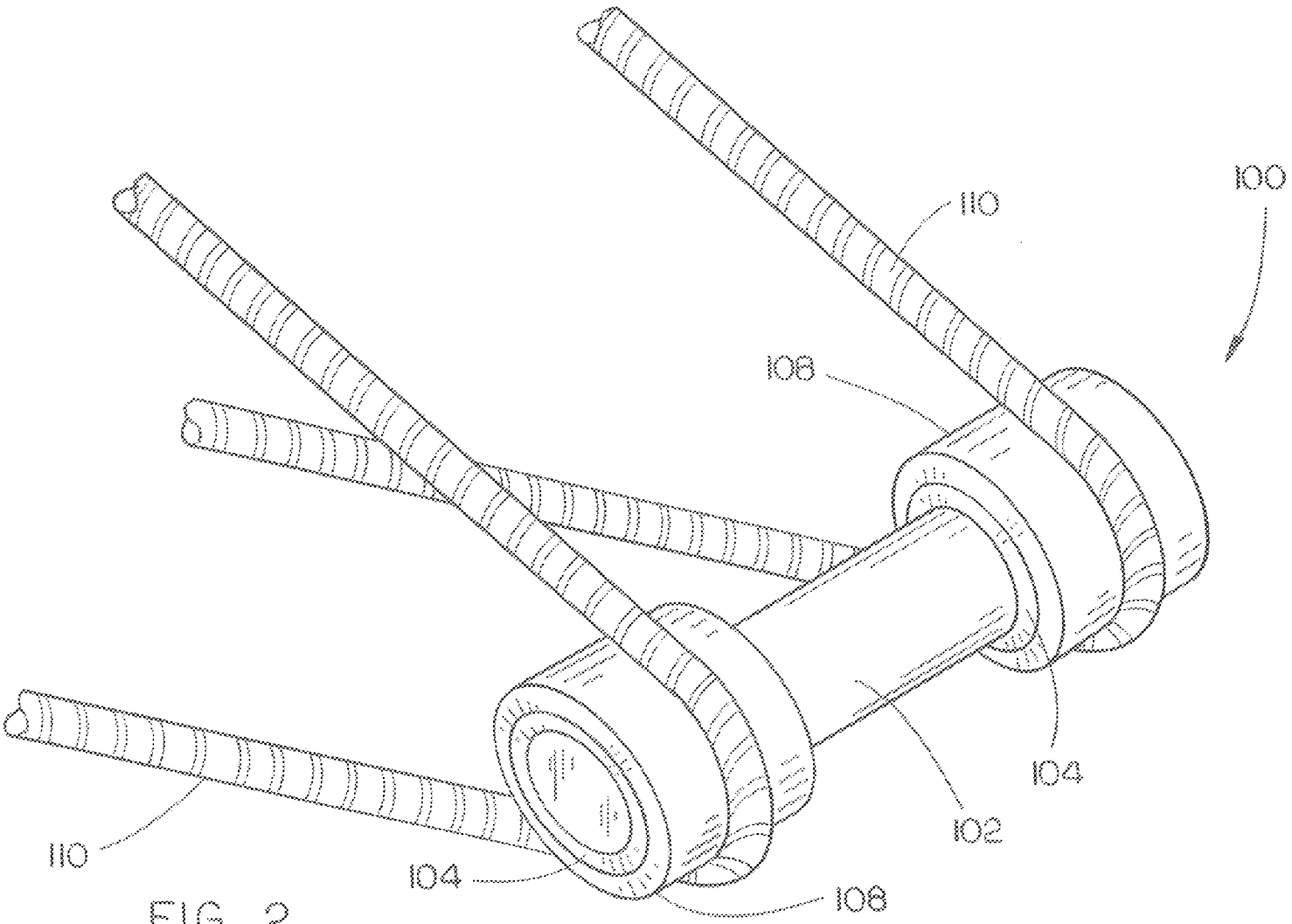
FIG. 2 is an isometric view of the lifting insert of FIG. 1.
Figure 4:
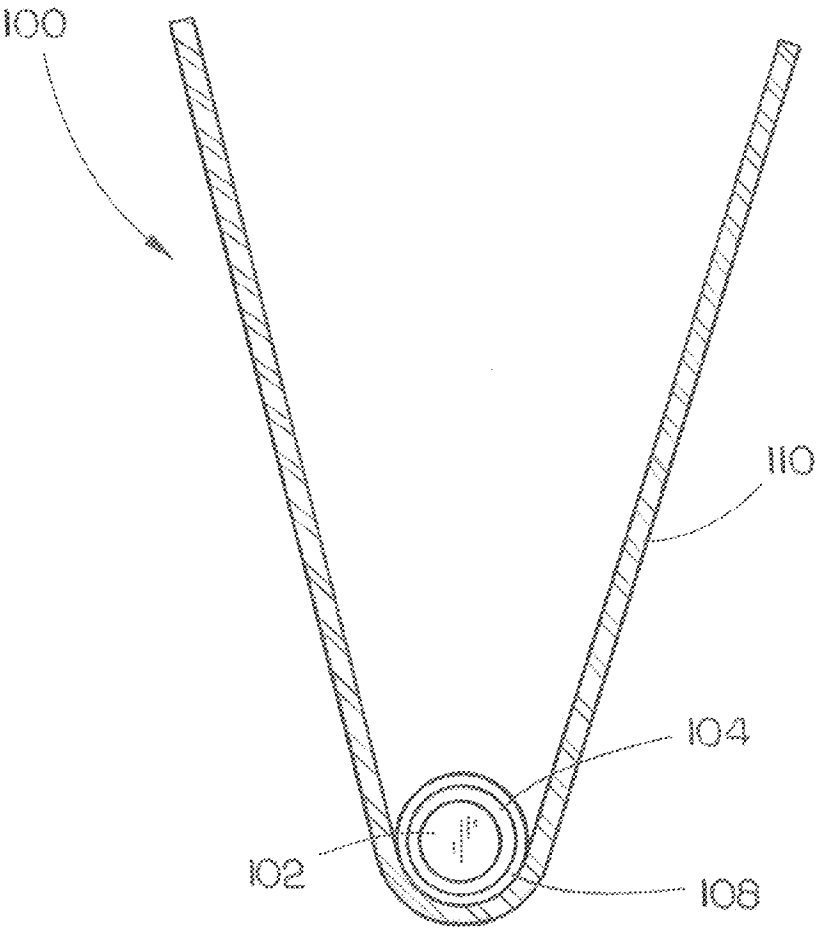
FIG. 4 is a side elevation view of the lifting insert of FIG. 1.
Figure 3:
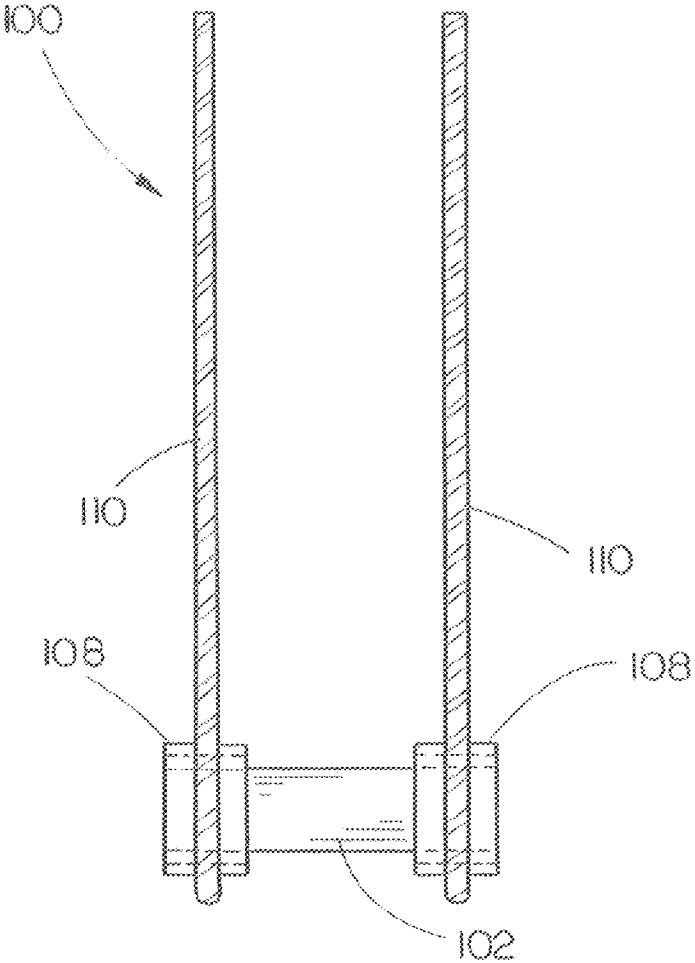
FIG. 3 is a front elevation view of the lifting insert of FIG. 1.

Reference will now be made in detail to the subject matter disclosed, which is illustrated in the accompanying drawings.

Referring generally to FIGS. 1 through 4, a lifting insert 100 for a concrete sandwich panel is shown. In one embodiment, the lifting insert 100 includes a fiberglass rod 102. Two end sleeves 104 are tightly secured to the two opposite ends of the fiberglass rod 102. The inner diameters of the two end sleeves 104 may substantially coincide with the outer diameter of the fiberglass rod 102, and the two end sleeves 104 may be mechanically pressed or glued onto the respective ends of the fiberglass rod 102 until the ends are flush. As depicted in the figures, the two end sleeves 104 are separated by a predetermined distance d apart from each other.

It is contemplated that the two end sleeves 104 tightly secured to the two opposite ends of the fiberglass rod 102 create confinement of the fibers of the fiberglass rod 102 and thus improve its stress resistance. This configuration enables the thermally insulated fiberglass rod 102 to resist much larger lifting forces than the intrinsic resistance, thus allowing the fiberglass rod 102 to be used as a part of the lifting insert in accordance with the present disclosure.

The lifting insert 100 also includes two anchoring members 106 for securing the two end sleeves. In one embodiment, each of the two anchoring members 106 further includes a metal sleeve 108 and a continuous steel bar 110. The inner diameter of the metal sleeve 108 (may also be referred to as the outer sleeve 108) generally coincides with the outer diameter of the end sleeve 104 (may also be referred to as the inner sleeve 104), allowing the outer sleeve 108 to be slipped onto the inner sleeve 104. The gap between the two sleeves 104 and 108 is not to exceed $1/16^{th}$ of an inch. The continuous steel bar 110 is bent at a midpoint along the length of the bar 110. The interior bend radius of the continuous steel bar 110 generally coincides with the outer radius of the outer sleeve 108, allowing the bar 110 to be secured to the outer sleeve 108 as shown in the figures. In this configuration, the outer sleeves 108 are for attachment of the steel bars 110 and for uniform bearing on the inner sleeves 104. The steel bars 110 are for gradual transmission of the force from the lifting insert to the concrete panels.

A key factor in successful load transfer is proper bearing contact between the bar 110, metal sleeve 108 and metal sleeve 104. It is contemplated that various techniques may be utilized for securing the bar 110 to the metal sleeve 108. For instance, in one embodiment, the bar 110 may be welded to the metal sleeve 108 at two or more locations.

Figure 5:
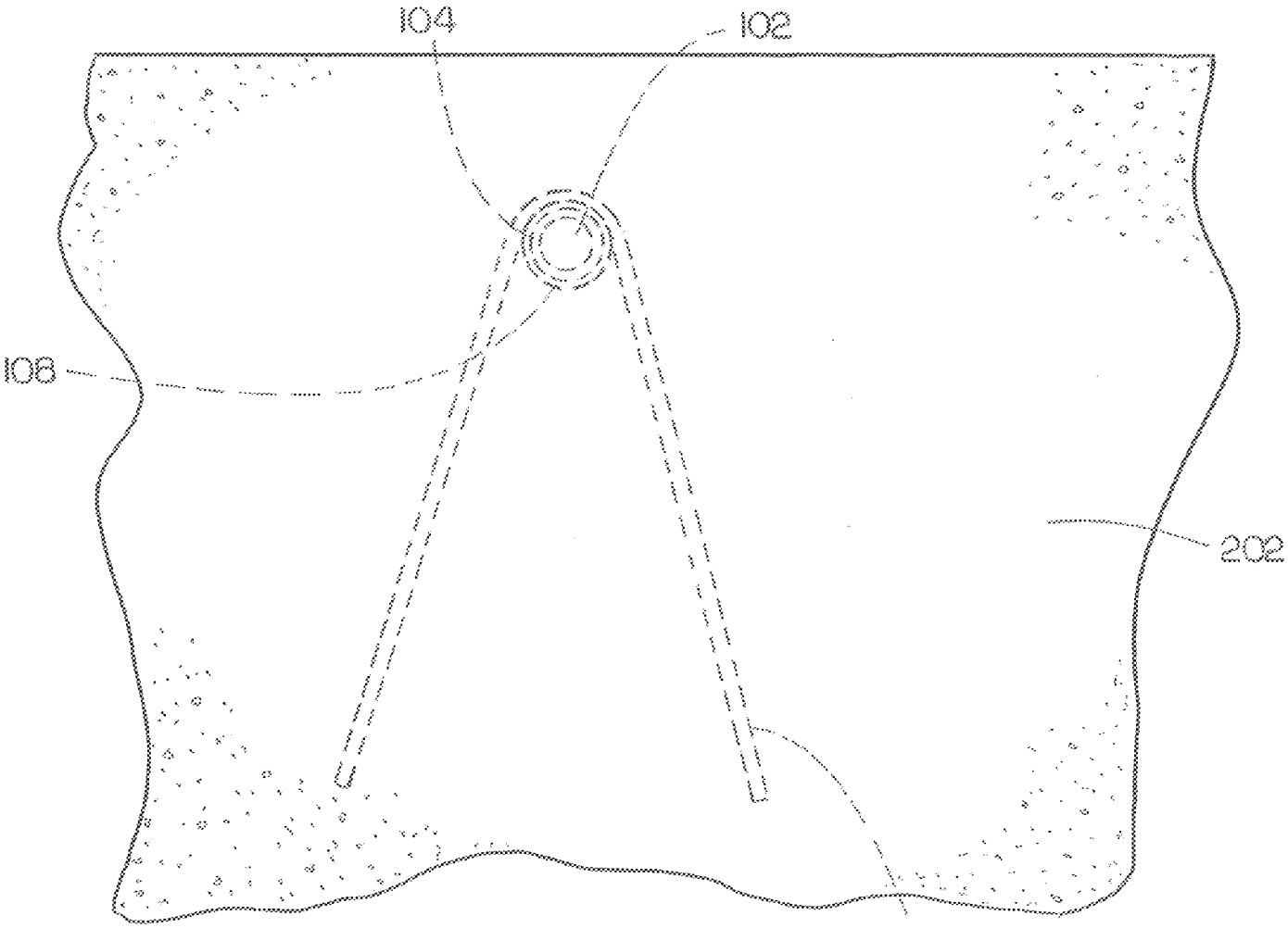
FIG. 5 is a top view of a concrete sandwich panel with a lifting insert installed.
Figure 6:
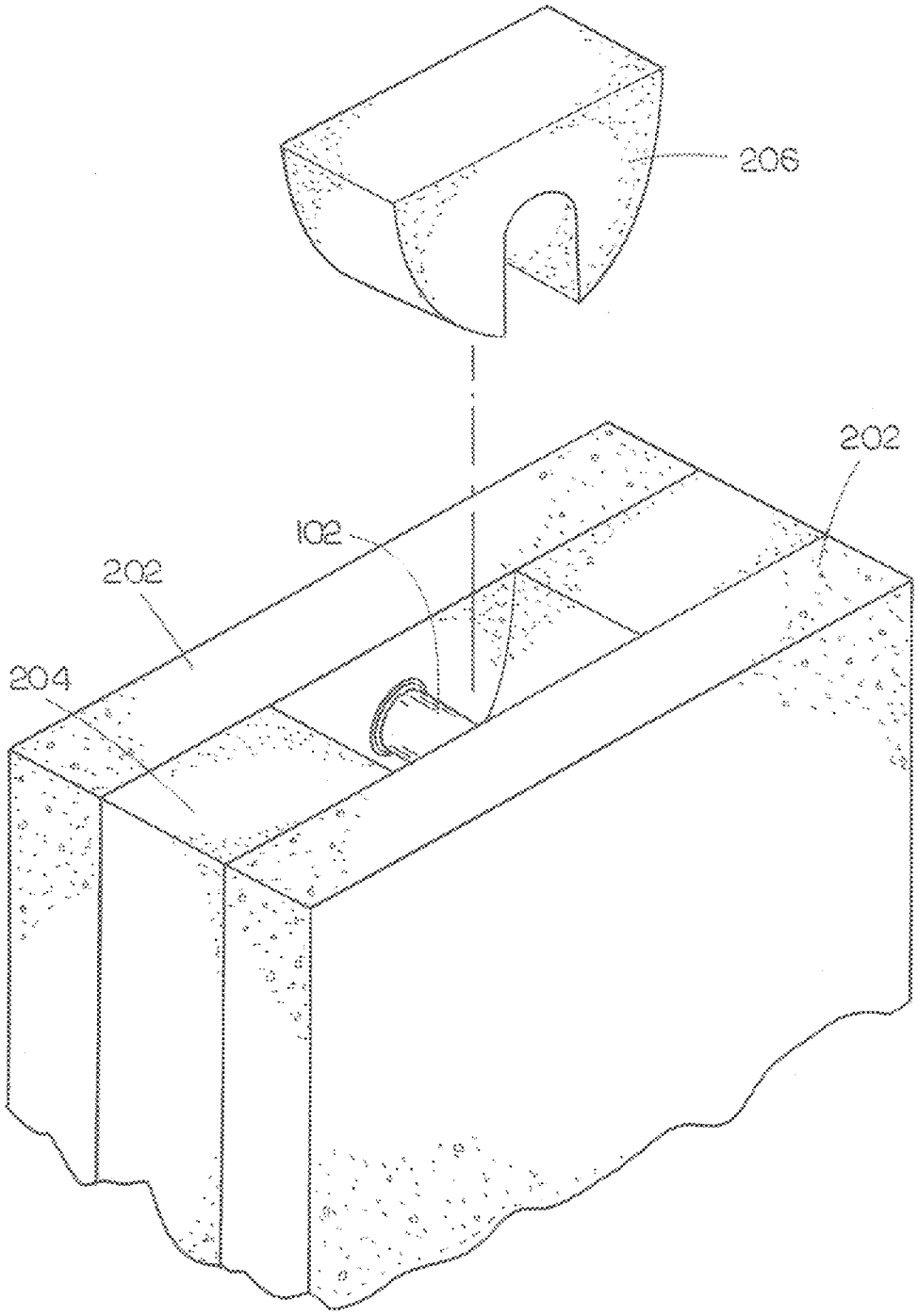
FIG. 6 is an isometric view of the concrete sandwich panel with the lifting insert installed.
Figure 8:
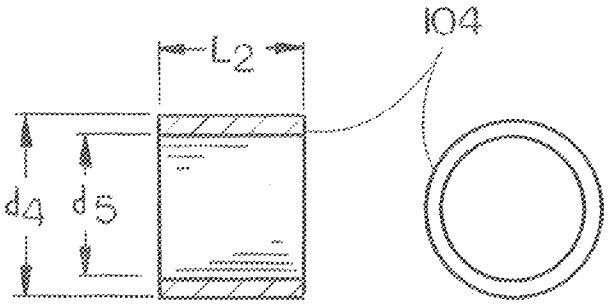
FIG. 8 is an illustration depicting a particular configuration of an end sleeve.
Figure 7:
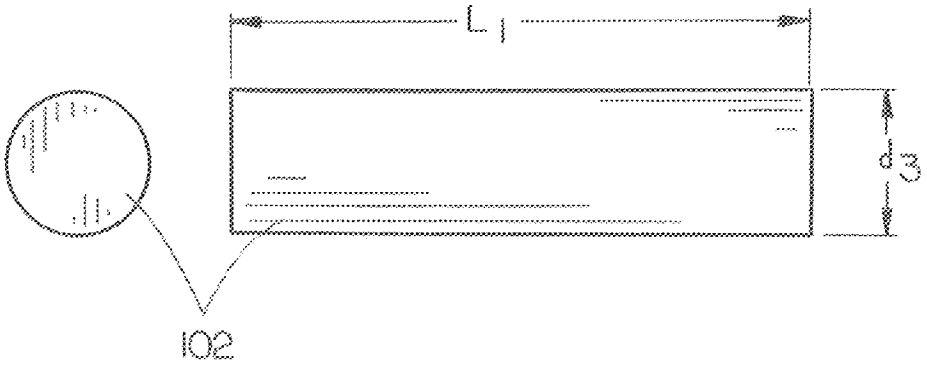
FIG. 7 is an illustration depicting a particular configuration of a fiberglass rod.
Figure 10:
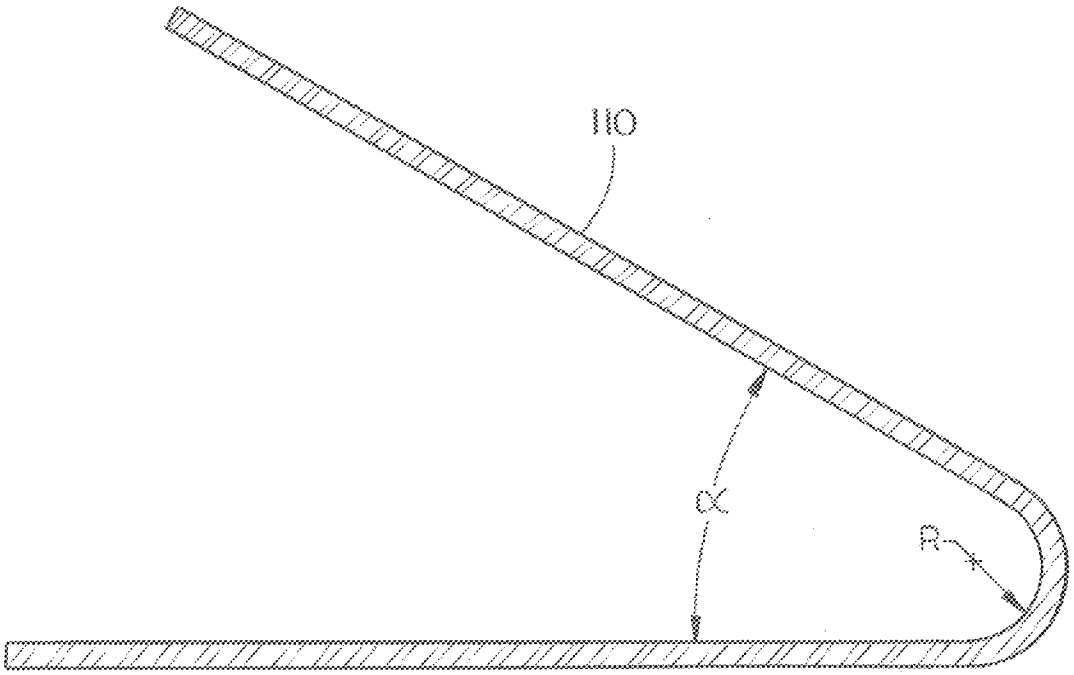
FIG. 10 is an illustration depicting a particular configuration of a bent bar.
Figure 9:
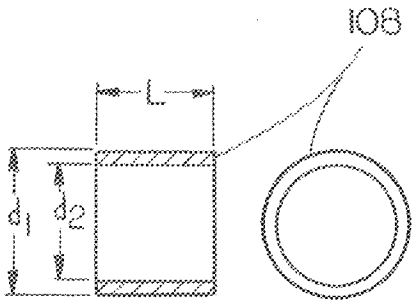
FIG. 9 is an illustration depicting a particular configuration of a metal sleeve.

FIGS. 5 and 6 are illustrations depicting a concrete sandwich panel 200 having a lifting insert 100 installed. Each anchoring member 106 is configured for anchoring one end of the fiberglass rod 102 within one wythe 202 of the concrete sandwich panel 200. The center portion of the fiberglass rod 102 is not formed within neither wythes of the concrete sandwich panel 200 and can be used to facilitate lifting of the panel 200. More specifically, as shown in FIGS. 5 and 6, the fiberglass rod 102 is connected to both wythes 202 of the concrete sandwich panel 200 through the insulation layer 204.

It is contemplated that a cutout portion 206 may be defined within the insulation layer 204. The cutout portion 206 is removed when the concrete sandwich panel 200 is cast in the factory and needs to be lifted, and may be positioned back in upon completion. It is also contemplated that the shape and size of the cutout portion 206 shown in the figures are merely exemplary. The cutout portion 206 may be defined in various shapes and sizes without departing from the spirit and scope of the present disclosure.

It is noted that the two end sleeves 104 are separated to prevent/reduce thermal bridging between the two wythes 202 of the concrete sandwich panel 200. In one embodiment, the distance d between the two end sleeves 104 generally coincides with the thickness of the insulation layer 204 (i.e., the distance between the two wythes 202).

It is contemplated that the particular size of the fiberglass rod 102 (e.g., length and/or circumference) may vary. For example, longer or larger fiberglass rods may be utilized for heavier or thicker sandwich panels and vice versa. Furthermore, the sleeves 104 and the anchoring members 106 may also vary based on the specification of the sandwich panel to be fabricated without departing from the spirit and scope of the present disclosure.

Alternatively, the configurations of the lifting inserts in accordance with the present disclosure may be standardized and produced as kits. Each lifting insert kit may include a fiberglass rod, two end sleeves and two anchoring members (each including a metal sleeve and a bent bar). Different standardized kit sizes may be produced, allowing users to select the appropriate lifting inserts that satisfy their requirements. It is contemplated that the standardized lifting inserts may be shipped pre-assembled or shipped separately and assembled any time prior to fabrication of the sandwich panels.

FIGS. 7 through 10 illustrate configurations of a standardized kit. More specifically, each sleeve 104 in this standardized kit is a steel sleeve having a length $L_2$ of approximately 2 inches. The inner diameter $d_5$ of each sleeve 104 is approximately 2 inches and the outer diameter $d_4$ of each sleeve is approximately 2.5 inches. The fiberglass rod 102 in this standardized kit is a cylindrical rod having a diameter $d_3$ of approximately 2 inches and a length $L_1$ of at least approximately 8 inches. When the sleeves 104 are secured to the rod 102 and the two ends are flush, the distance between the two sleeves 104 measures at least approximately 4 inches.

In addition, the metal sleeves 108 in the standardized kit are also steel sleeves that are approximately 2 inches long. The inner diameter $d_2$ of each metal sleeve 108 generally coincides with the outer diameter of the sleeve 104, and is 1/16 of an inch greater than the outer diameter $d_4$ of the sleeve 104 in certain embodiments. The outer diameter $d_1$ of each metal sleeve 108 is approximately 3.125 inches. Furthermore, the continuous steel bar 110 in this standardized kit is a #4 or #5 rebar approximately 48 inches long. The continuous bar 110 is bent at its midpoint approximately 30 degrees with an interior radius of approximately 1.625 inches. This allows the continuous steel bar 110 to be secured to the metal sleeve 108 as shown in the figures.

It is contemplated that the specific size and dimension depicted in FIGS. 7 through 10 are merely exemplary for one particular kit configuration in accordance with one embodiment of the present disclosure. It is understood that different kit sizes and configurations may be defined and produced for users to choose from without departing from the spirit and scope of the present disclosure.

Figure 11:
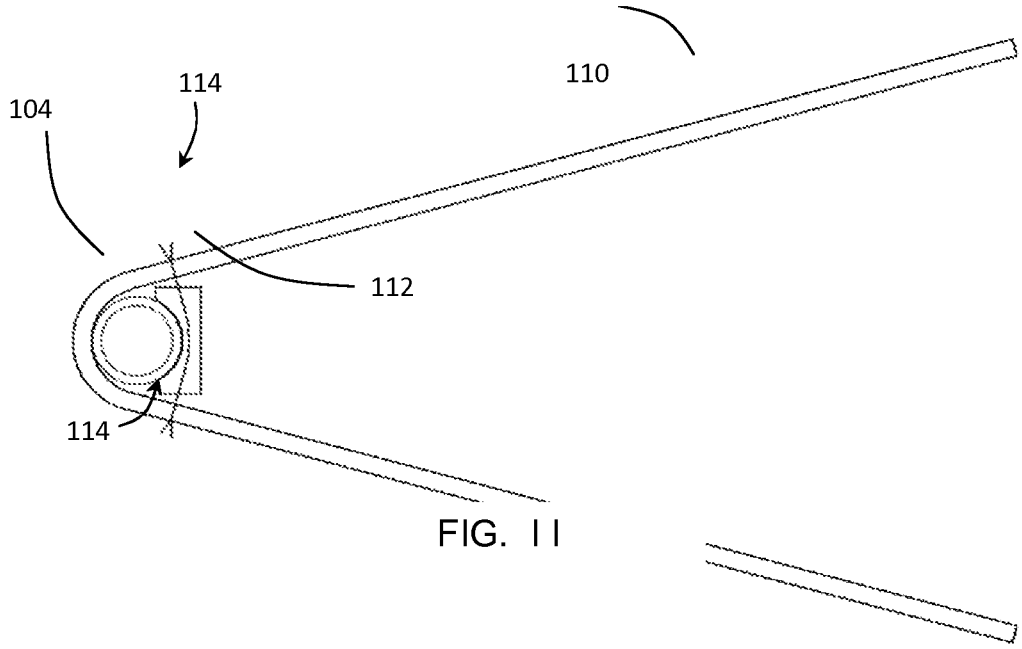
FIG. 11 is an illustration depicting an alternative anchoring member for securing a bar to a sleeve.
Figure 12:
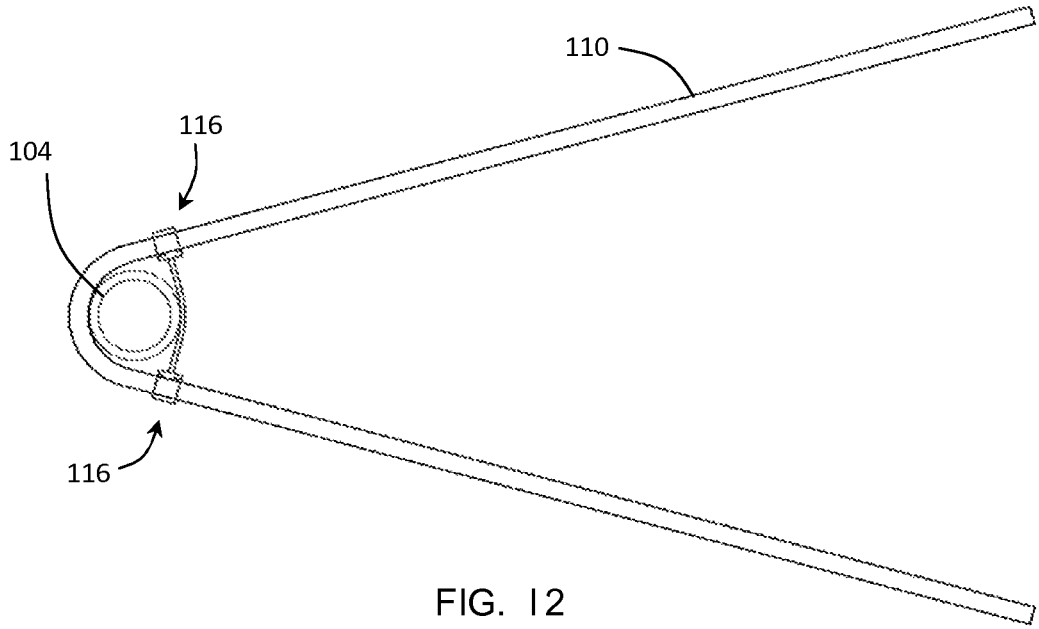
FIG. 12 is an illustration depicting another alternative anchoring member for securing a bar to a sleeve.
Figure 13:
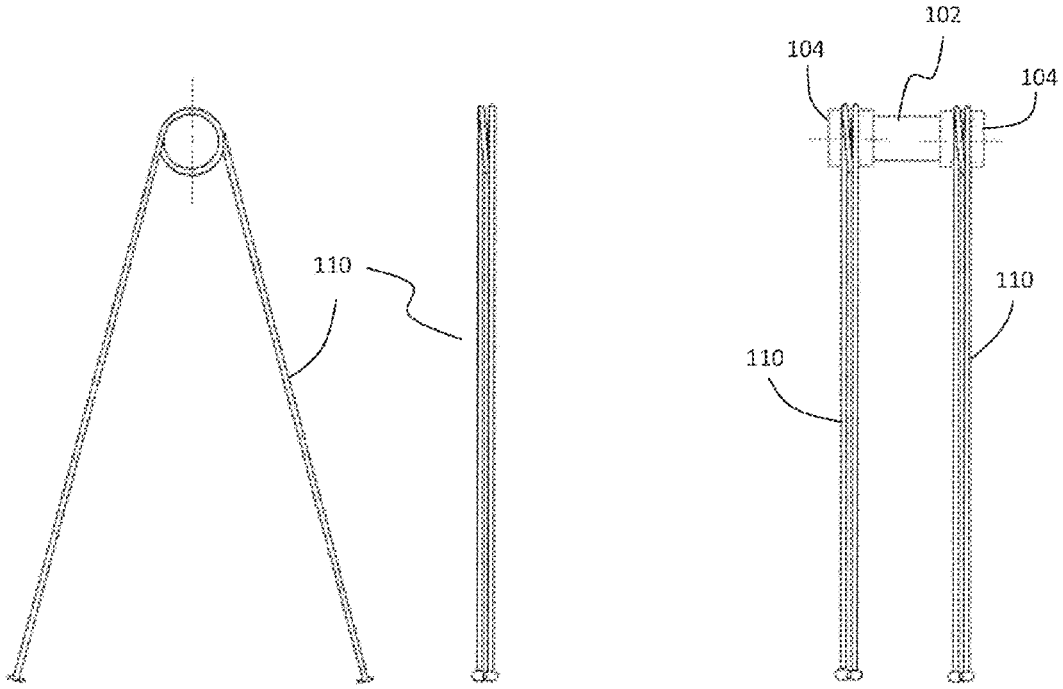
FIG. 13 is an illustration depicting still another alternative anchoring member for securing a bar to a sleeve.

It is also contemplated that the anchoring members 106 depicted in the figures are merely exemplary. Alternative anchoring members may also be utilized for securing the bars 110 to the end sleeves 104. For instance, as shown in FIG. 11, a preformed concrete block 112 with embedded tie wires 114 may be used to secure the bar 110 to the inner sleeve 104. In another example, as shown in FIG. 12, strap clips or clamps 116 may be used to secure the bar 110 to the inner sleeve 104. In still another example, the bar 110 may be looped around the inner sleeve 104 as shown in FIG. 13 and secured to the sleeve 104 in that manner. It is noted that the outer sleeves 108 as previously described may be optional in these alternative embodiments, as no welding base metal would be needed. It is also contemplated that other techniques may be utilized to secure the bars 110 to the end sleeves 104 without departing from the spirit and scope of the present disclosure.

Figure 14:
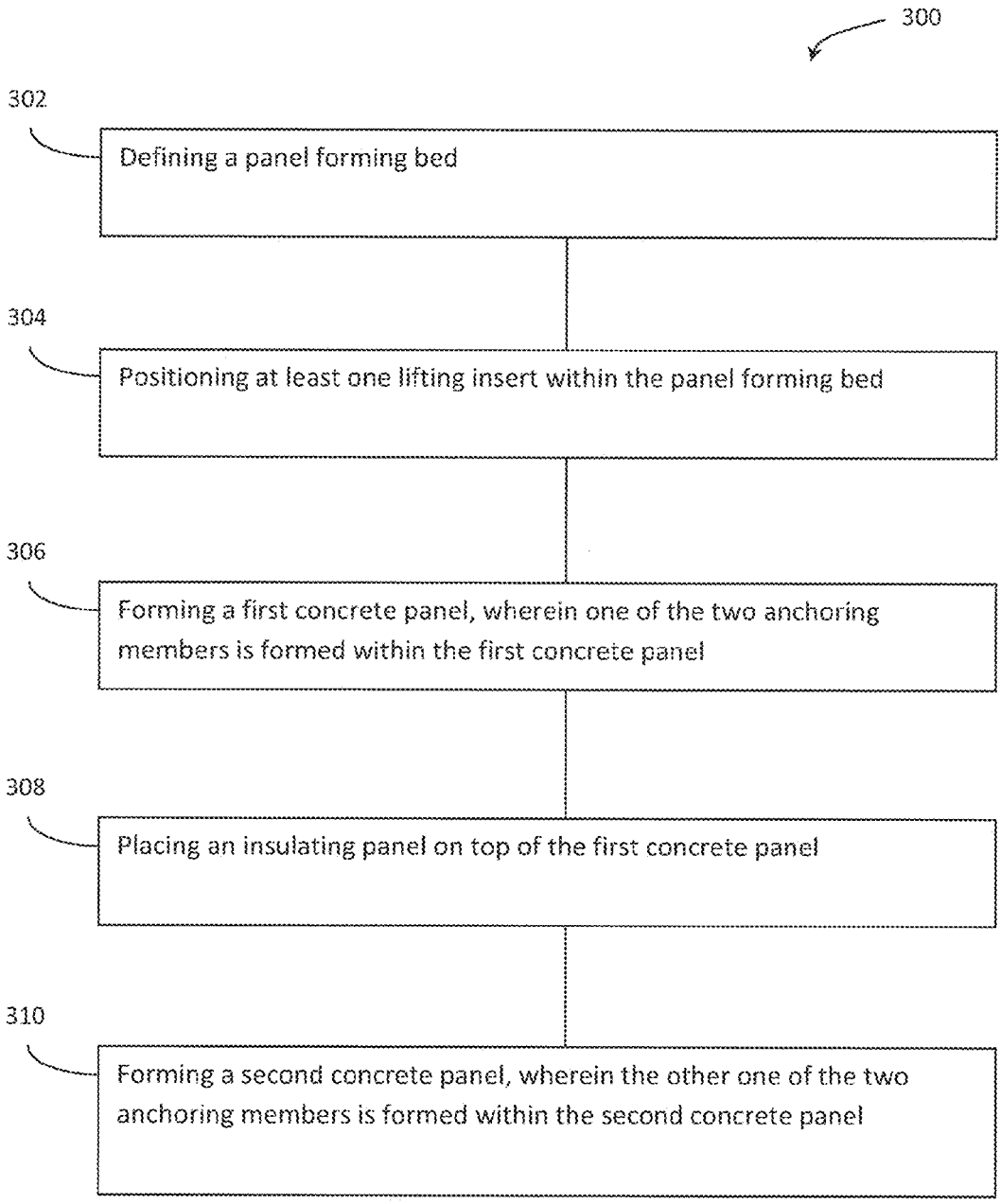
FIG. 14 is a flow diagram illustrating a method for constructing concrete sandwich panel with one or more lifting inserts.

As previously mentioned, lifting inserts in accordance with the present disclosure may be shipped pre-assembled or shipped separately and assembled any time prior to fabrication of a sandwich panel. FIG. 14 shows a flow diagram illustrating a method 300 for constructing a concrete sandwich panel. In one embodiment, the concrete sandwich panel is formed on a generally planar panel forming system (may be referred to as bed). The panel forming system may include two slidable side members for defining the width of the sandwich panel and two slidable head members for defining the length of the sandwich panel. The height of the side members and the head members may be adjusted according to the desired thickness of the sandwich panel.

Step 302 may first configure the dimension of the sandwich panel to be formed. Step 304 may position one or more lifting inserts within the panel forming bed. The lifting inserts may be suspended from the top and/or the sides and held in place when concrete mix is poured into the panel forming bed to form the first wythe in step 306. In this manner, the bottom (with respect to the orientation of the panel forming bed) end of each fiberglass rods and its anchoring member is anchored within the first (i.e., bottom) wythe. In one embodiment, the minimum distance between the lifting insert and the edge of the panel forming bed is at least 3 inches.

Step 308 may then place insulating panels on top of the first wythe. Cutout portions may be defined on the insulating panels to accommodate the space needed for the lifting inserts. It is contemplated that the cutout portions may be precut based on known locations of the lifting inserts, or they may be cut as the insulating panels are being placed.

Upon placement of the insulating panels, step 310 may subsequently pour concrete mix into the panel forming bed on top of the insulating panels to form the second (i.e., top) wythe. It is contemplated that the lifting inserts may still be suspended from the sides and held in place when the second wythe is being formed. In this manner, the top end of each fiberglass rods and its anchoring member is anchored within the second wythe.

It is contemplated that various reinforcement members may be installed within the wythes of the sandwich panel. In addition, various types of tying members may also be utilized to mechanically joining the insulating panels to the wythes of the sandwich panel without departing from the spirit and scope of the present disclosure.

While the sandwich panels are generally rectangular, it is understood that the lifting inserts in accordance with the present disclosure may be utilized (formed within) sandwich panels of different shapes (e.g., triangular or circular shaped sandwich panels) without departing from the spirit and scope of the present disclosure.

The methods disclosed may be implemented as sets of instructions, through a single production device, and/or through multiple production devices. Further, it is understood that the specific order or hierarchy of steps in the methods disclosed are examples of exemplary approaches. Based upon design preferences, it is understood that the specific order or hierarchy of steps in the method can be rearranged while remaining within the scope and spirit of the disclosure. The accompanying method claims present elements of the various steps in a sample order, and are not necessarily meant to be limited to the specific order or hierarchy presented.

It is believed that the system and method of the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory.

What is claimed is:

1. A lifting insert for a concrete sandwich panel, comprising:

a fiberglass rod;

two end sleeves secured to two opposite ends of the fiberglass rod, the two end sleeves being separated by a predetermined distance apart from each other; and two anchoring members secured to the two end sleeves, each of the two anchoring members further comprising:

a metal sleeve having an inner diameter generally coinciding with an outer diameter of the end sleeve; and a continuous steel bar bent at a midpoint along the length of the continuous steel bar, the continuous steel bar having an interior bend radius generally coinciding with an outer radius of the metal sleeve;

wherein each of the anchoring members is configured for anchoring one end of the fiberglass rod within one wythe of the concrete sandwich panel.

2. The lifting insert of claim 1, wherein the two end sleeves are force fit or glued to the fiberglass rod.

3. The lifting insert of claim 1, wherein the two anchoring members are force fit to the two end sleeves.

4. The lifting insert of claim 1, wherein the length is approximately 2 inches.

5. The lifting insert of claim 1, wherein the predetermined distance separating the two end sleeves coincides with a thickness of an insulation board of the concrete sandwich panel.

6. The lifting insert of claim 1, wherein the continuous steel bar is bent approximately 30 degrees at the midpoint.

7. The lifting insert of claim 1, wherein the continuous steel bar is secured to the metal sleeve by at least one of: welding, clamping with a clamp or tying with a wire tie.

* * * * *